US010682564B2

(12) United States Patent
Brandl et al.

(10) Patent No.: US 10,682,564 B2
(45) Date of Patent: Jun. 16, 2020

(54) ULTRALIGHT FRONT JAW

(71) Applicant: MARKER Deutschland GmbH, Penzberg (DE)

(72) Inventors: Christian Brandl, Garmisch-Partenkirchen (DE); Markus Krumbeck, Farchant (DE)

(73) Assignee: MARKER Deutschland GmbH, Penzberg (DE)

( * ) Notice: Subject to any disclaimer, the term of this patent is extended or adjusted under 35 U.S.C. 154(b) by 0 days.

(21) Appl. No.: 16/509,583

(22) Filed: Jul. 12, 2019

(65) Prior Publication Data

US 2019/0336844 A1 Nov. 7, 2019

Related U.S. Application Data

(63) Continuation of application No. 16/124,584, filed on Sep. 7, 2018, now Pat. No. 10,391,383.

(30) Foreign Application Priority Data

Sep. 7, 2017 (DE) ..... 10 2017 120 701

(51) Int. Cl.

| | |
|---|---|
| ***A63C 9/10*** | (2012.01) |
| ***A63C 9/22*** | (2012.01) |
| ***A63C 9/08*** | (2012.01) |
| ***A63C 9/085*** | (2012.01) |
| ***A63C 9/086*** | (2012.01) |

(52) U.S. Cl.

CPC ..... *A63C 9/10* (2013.01); *A63C 9/086* (2013.01); *A63C 9/0807* (2013.01); *A63C 9/08528* (2013.01); *A63C 9/22* (2013.01)

(58) Field of Classification Search

CPC ..... A63C 9/10; A63C 9/22; A63C 9/0807; A63C 9/08528; A63C 9/086

See application file for complete search history.

(56) References Cited

U.S. PATENT DOCUMENTS

| | | | | |
|---|---|---|---|---|
| 4,394,032 | A * | 7/1983 | Storandt | A63C 9/086 280/618 |
| 2011/0271557 | A1 | 11/2011 | Barthel | |
| 2011/0298196 | A1 | 12/2011 | Lehner | |
| 2013/0181427 | A1 | 7/2013 | Fritschi | |
| 2013/0307252 | A1 | 11/2013 | Crema et al. | |
| 2013/0328289 | A1 | 12/2013 | Vailli et al. | |
| 2014/0001733 | A1 | 1/2014 | Bennert | |

(Continued)

*Primary Examiner* — Bryan A Evans

(74) *Attorney, Agent, or Firm* — RatnerPrestia

(57) ABSTRACT

A front jaw for a touring ski binding, includes a base and at least one recess or transit opening in the base. Lateral sole retainers lie opposite each other in relation to a longitudinal axis of the front jaw each include a boot retainer pin and, in a pivoted-in state, co-operate with bearings formed on a ski boot, defining a pivoting axis for the boot extending substantially transverse to the longitudinal axis of the front jaw, and are adjustable between the pivoted-in state, where the bearings of the boot engage the boot retainer pins, and a pivoted-away state where the bearings of the boot are not engaged with the boot retainer pins; spring elements for tensioning the lateral sole retainers; a tensioning lever for moving the sole retainers from the pivoted-in state to the pivoted-away state to release the ski boot from a downhill skiing position or a walking position.

21 Claims, 5 Drawing Sheets

(56) References Cited

U.S. PATENT DOCUMENTS

| | | | | |
|---|---|---|---|---|
| 2014/0137439 | A1 | 5/2014 | Pegolo et al. | |
| 2014/0159345 | A1 | 6/2014 | Indulti | |
| 2015/0328529 | A1* | 11/2015 | Trabucchi ..... | A63C 9/10<br>280/11.33 |
| 2015/0335987 | A1 | 11/2015 | Nobile | |

* cited by examiner

ULTRALIGHT FRONT JAW

CROSS-REFERENCE TO RELATED APPLICATIONS

This application is a continuation of U.S. patent application Ser. No. 16/124,584, filed Sep. 7, 2018 which claims priority to German Patent Application No. 10 2017 120 701.5, filed Sep. 7, 2017, the contents of such applications being incorporated by reference herein.

FIELD OF THE INVENTION

The invention relates to a front jaw for a touring ski binding, comprising a base and an at least one recess or transit opening in the base, lateral sole retainers comprising boot retainer pins which can connect the front jaw to a ski boot, such that when the binding is in a touring mode, the ski boot can pivot in the front jaw about an axis transverse to a longitudinal axis of the binding in the skiing direction. The front jaw also comprises tensioning means for tensioning the sole retainers and, optionally, a latching device using which the sole retainers can be latched in the position in which they are connected to the ski boot.

BACKGROUND OF THE INVENTION

For ski tourers especially, the weight of the ski together with the binding plays an ever more important role, since every gram saved in weight makes ski touring easier.

SUMMARY OF THE INVENTION

Therefore an aspect of the invention is a front jaw for a touring ski binding which has a low inherent weight, is secure, consists of as few individual parts as possible and can be manufactured economically.

One aspect of the invention relates to a front jaw for a touring ski binding, comprising a base with at least one recess or transit opening in the base. The front jaw also comprises two sole retainers comprising boot retainer pins which can engage laterally with corresponding receptacles in the ski boot sole, in order to hold the ski boot in the front jaw during ski touring and preferably also during downhill skiing, such that the ski boot can be pivoted, during ski touring, about an axis which extends through the boot retainer pins and the receptacles of the ski boot sole.

The boot retainer pins can in particular be on two bearing portions which lie opposite each other in relation to a longitudinal axis of the ski and co-operate with the corresponding receptacles on the sides of the ski boot sole facing them and forming a complementary bearing for the bearing portions. The boot retainer pins or bearing portions can be moved into and out of the complementary bearings by pivoting the sole retainers substantially transverse to the longitudinal axis of the ski. In a pivoted-in state, the complementary bearings and the bearing elements accommodated therein define a pivoting axis transverse to the longitudinal axis of the ski and connect the ski boot, such that it can be pivoted in the pivoting axis, to the touring ski binding. In a pivoted-away state, in which the bearing elements no longer engage with the complementary bearings, the touring ski binding is in an opened position, such that the user can step into or out of the touring ski binding.

The front jaw also comprises tensioning means for tensioning the sole retainers and, optionally, a latching device using which the sole retainers can be latched at least for walking. Lastly, the front jaw comprises at least one cover which is made of an elastic material and covers the at least one recess or transit opening in the base, preferably at least substantially completely.

The base is understood here to be a component for a front jaw, which: can be connected to a ski or to a binding plate which can be connected, preferably connected fixedly, to the ski; and is arranged to accommodate the sole retainers and, optionally, to perform other functions.

The base or base body preferably surrounds the at least one recess or transit opening in the shape of a frame, i.e. it encloses it/them completely, preferably with no opening or interruption in the frame-shaped component.

The base for the front jaw can be original-moulded in one part and for example manufactured from a near-non-deformable plastic or a light metal such as aluminium or magnesium, for example in an injection-moulding method or a generative method. The base can also be constructed from multiple materials, i.e. it can for example comprise plastic and/or a metal and/or multiple metals. The plastic can be a reinforced plastic. It can for example be reinforced with glass, carbon, metal or other materials suitable for this purpose. The base can be manufactured off-tool, i.e. such that it does not require subsequent machining or only requires a negligibly small amount of subsequent machining.

The recess can be a substantially level region which is recessed with respect to the remaining geometry of the base and suitable for accommodating the cover. The recess can also constitute a flat, for example cup-shaped recess with a level bottom. The recess can however also be sub-divided by one or more elevations, for example strut-shaped elevations, wherein if there are multiple elevations, the elevations can have a same or lower height as the edge of the recess which connects the bottom of the recess to the upper side of the base.

The cover or covers can (each) be manufactured as a separate part from the base, likewise in one piece, for example from an elastic plastic material such as for example an elastomer, preferably a thermoplastic elastomer such as for example TPU. The cover, or each of the covers, can comprise: a planar cover region which spans the recess/recesses or transit opening/openings of the base and is adapted to the shape of the at least one recess or, respectively, transit opening; and, optionally, connecting elements with which the cover can be connected to the base, preferably in a positive fit and/or in a force fit. The connecting elements can be able to be connected to the base and the cover; the connecting elements are preferably connected to the cover in a material fit and particularly preferably moulded onto the cover during manufacture. The base can have complementary connecting elements with which the connecting elements, which are preferably connected firmly to the cover, can for example engage in order to connect the cover, preferably detachably, to the base or to fasten the cover, preferably detachably, to the base.

In order to connect the cover to the base captively, the cover for the recess can be connected to the base on an upper side of the base facing away from the surface of the ski and/or in the recess. If, as is preferred, the base has the transit opening, a lower side of the base facing the surface of the ski can be connected to the cover (3). If the base or, respectively, the front jaw is connected to the ski, the cover can no longer detach from the base.

In modifications, the base and the cover/covers can be connected to each other in a material fit. The cover/covers can then for example be fused or glued to the base, or the base and cover/covers can for example be jointly original-moulded in a two-component injection-moulding method. In the following, further details of the cover or covers are described on the basis of one cover, in order to keep the description legible. Within the framework of this invention, however, what is described is intended to apply to one or more or all of the covers, if there are multiple covers.

The cover region of the cover preferably does not have any openings but rather forms a closed area. At least an upper side of the cover facing the sole of the boot can have a smooth or very finely structured surface. The material for the cover can in particular be an elastic material which advantageously has water-repellent, snow-repellent, ice-repellent and/or dirt-repellent properties or has a coating which exhibits said properties at least on the upper side facing the ski boot. The surface of the cover can be printable.

On a lower side facing away from the ski boot, the cover can have one or more strut-shaped reinforcements which in particular reinforce(s) an outer, preferably all-round edge and/or the cover region of the cover. When the base is fitted on the ski, an end face of the strut-shaped reinforcements which points away from the lower side of the cover can lie on a surface of the bottom of the recess or ski, such that elastic membrane regions are formed between the reinforcements, wherein said elastic membrane regions can prevent snow, ice or dirt from accumulating on the surface of the cover, in particular while walking in skis, by elastically flexing in and out. This can prevent—more reliably than before—a layer of snow, ice and/or dirt from accumulating underneath the ski boot in the region of the ball of the foot and for example stopping the ski boot from lowering completely onto the ski.

The base can comprise an abutment for a front end of the ski boot. The base can in particular form a base structure for the one abutment, and the abutment itself can be formed from an elastic material which is connected to said base structure, preferably detachably, for example in a positive fit. Forming the abutment from an elastic material has the advantage that it enables production tolerances of the ski boot sole to be automatically compensated for, such that it is possible to easily step into the binding, and the ski boot is firmly accommodated in the binding, independently of any production tolerances of the sole.

The elastic material for the abutment can advantageously be the same material as the cover is produced from. It can be particularly advantageous if the abutment is or can be connected to the cover. It is even more advantageous if the abutment is original-moulded in one piece with the cover or with one of the covers, i.e. for example manufactured in a mould in a thermoplastic injection-moulding method, preferably off-tool.

The abutment can consist of two partial abutments which are spaced from each other in a direction transverse to a longitudinal centre axis of the binding. In this case, each of the partial abutments can respectively comprise an elastic abutment which, as described, preferably consists of the material of the cover and is preferably manufactured in a common mould together with the cover.

The base can comprise two receptacles for two axial bodies, which lie opposite each other in relation to the longitudinal centre axis of the binding and can accommodate axles which are connected to the sole retainers or formed partly by the sole retainers or which can accommodate the sole retainers. The base and the axles, or the axles and the sole retainers, form rotary joints about which the sole retainers can be pivoted from the side onto the ski boot sole and away from the ski boot sole, wherein the axles are preferably arranged substantially parallel to the longitudinal centre axis of the ski binding.

The two sole retainers can be connected to each other or engaged with each other in an additional pivoting joint, at an end facing away from the boot retainer pins, such that the two sole retainers cannot pivot independently of each other. The additional pivoting joint can for example be formed by mutually facing ends of setting elements which are connected to the sole retainers and around which the end of a tensioning lever protrudes in the shape of a fork and which can be jointly raised or lowered, substantially perpendicular to the surface of the ski, by the tensioning lever, wherein each of the sole retainers can comprise a tensioning means, such as for example preferably one spring, which tensions the respective sole retainer into a first and/or second position. The pivoting axis for the additional pivoting joint preferably extends substantially parallel to the central longitudinal axis of the ski binding.

Features of the invention are also described in the aspects formulated below. The aspects are worded in the manner of claims and can substitute for them. Features disclosed in the aspects can also supplement and/or qualify the claims, indicate alternatives with respect to individual features and/or broaden claim features. Bracketed reference signs refer to an example embodiment of the invention which is illustrated below in figures. They do not restrict the features described in the aspects to their literal sense as such, but do conversely indicate preferred ways of realising the respective feature.

Aspect 1. A front jaw for a touring ski binding, comprising:

a) a base (1) and b) at least one recess or transit opening (2) in the base (1);

c) two lateral sole retainers (13) which lie opposite each other in relation to a longitudinal axis (L) of the front jaw and comprise a boot retainer pin (14) each and which, in a pivoted-in state, co-operate with complementary bearings formed on a ski boot, in order to define a pivoting axis for the ski boot which extends substantially transverse to the longitudinal axis (L) of the front jaw, and which can be adjusted between the pivoted-in state, in which the complementary bearings of the ski boot engage with the boot retainer pins (14), and a pivoted-away state in which the complementary bearings of the ski boot no longer engage with the boot retainer pins (14);

d) spring elements (15) for tensioning the lateral sole retainers (13);

e) a tensioning lever (16) for moving the sole retainers (13) from the pivoted-in state to the pivoted-away state in which they release the ski boot from a downhill skiing position or a walking position; and f) optionally, a latching lever (17) for latching the lateral sole retainers (13) in the walking position, g) wherein the at least one recess or transit opening (2) is covered by at least one cover (3) made of an elastic material.

Aspect 2. The front jaw according to Aspect 1, wherein the at least one recess or transit opening (2) is completely covered by the at least one cover (3).

Aspect 3. The front jaw according to any one of the preceding aspects, wherein the base (1) surrounds the recess or transit opening (2) in the shape of a frame.

Aspect 4. The front jaw according to any one of the preceding aspects, wherein the at least one cover (3) is formed in one part.

Aspect 5. The front jaw according to any one of the preceding aspects, wherein the cover (3) or covers is/are detachably connected to the base (1).

Aspect 6. The front jaw according to the preceding aspect, wherein the respective cover (3) is connected to the base (1) in a positive fit and/or in a force fit.

Aspect 7. The front jaw according to any one of the preceding aspects, wherein the cover/covers (3) comprises an at least substantially all-round circumferential edge (3*b*) on a lower side facing away from a ski boot sole, wherein said circumferential edge (3*b*) forms a contact area of the cover (3) on an upper side of the recess or the surface of the ski facing the cover.

Aspect 8. The front jaw according to the preceding aspect, wherein the cover/covers (3) comprises additional rib-shaped reinforcements (3*k*, 3*l*) on the lower side facing away from the ski boot sole, wherein said reinforcements (3*k*, 3*l*) form a contact area of the cover (3) on an upper side of the recess or the surface of the ski facing the cover.

Aspect 9. The front jaw according to any one of the preceding two aspects, wherein regions (3*m*, 3*n*) of the cover/covers (3) between the contact area of the circumferential edge (3*b*) and/or additional reinforcements (3*k*, 3*l*) form elastic membrane regions which prevent snow, ice or dirt from accumulating on the surface of the cover/covers (3).

Aspect 10. The front jaw according to any one of the preceding aspects, wherein the cover (3) has: a raised planar region (3*a*) comprising an upper free surface facing the ski boot sole; and a holding flange (3*c*) which protrudes outwards from the raised planar region (3*a*), and wherein the raised planar region (3*a*) projects upwards from the holding flange (3*c*) and at least substantially fills the transit opening (2) or recess in a plan view onto the front jaw.

Aspect 11. The front jaw according to any one of the preceding aspects, wherein the cover (3) is held in position by the base (1) when the front jaw is fitted on the ski.

Aspect 12. The front jaw according to the preceding aspect, wherein the base (1) co-operates with the holding flange (3*c*) in order to hold the cover (3) in position.

Aspect 13. The front jaw according to any one of the preceding aspects, wherein the base (1) forms a constrainer for the cover (3) and presses the cover (3) towards and preferably against the upper side of the ski when the front jaw is fitted on the ski.

Aspect 14. The front jaw according to the preceding aspect in combination with Aspect 10, wherein the base (1) presses the holding flange (3*c*) and thus the cover (3) towards the upper side of the ski.

Aspect 15. The front jaw according to any one of the preceding aspects, wherein:

the cover (3) has a planar region (3*a*) comprising an elastically yielding membrane having an upper free surface facing the ski boot sole;

said planar region (3*a*) at least substantially fills the transit opening (2) or recess in a plan view onto the front jaw;

the cover (3) has a hollow space (3*n*, 3*m*) below the membrane or forms a hollow space (3*n*, 3*m*) below the membrane when the front jaw is fitted; and the membrane can yield into the hollow space (3*n*, 3*m*).

Aspect 16. The front jaw according to the preceding aspect, wherein the lower side of the cover (3) has a depression, below the membrane, in order to form the hollow space (3*n*, 3*m*).

Aspect 17. The front jaw according to any one of the immediately preceding two aspects, wherein the hollow space (3*m*, 3*n*) forms a compressible air cushion for the membrane, at least when the front jaw is fitted.

Aspect 18. The front jaw according to any one of the immediately preceding three aspects, wherein the lower side of the cover (3) has a circumferential edge (3*b*) which laterally surrounds the hollow space (3*m*, 3*n*) and presses against the upper side of the ski when the front jaw is fitted.

Aspect 19. The front jaw according to any one of the preceding aspects, wherein the recess or transit opening (2) and the cover (3) extend below the toe region of the ski boot.

Aspect 20. The front jaw according to any one of the preceding aspects, wherein the recess or transit opening (2) and the cover (3) extend between the lateral sole retainers (13).

Aspect 21. The front jaw according to any one of the preceding aspects, wherein the recess or transit opening (2) and the cover (3) overlap with the boot retainer pins (14) in relation to the longitudinal direction of the front jaw.

Aspect 22. The front jaw according to any one of the preceding aspects, wherein the cover (3) spans or at least substantially fills the recess or transit opening (2) in a plan view onto the front jaw.

Aspect 23. The front jaw according to any one of the preceding aspects, wherein the front jaw comprises at least one abutment (5, 5*a*, 5*b*) for a front end of a ski boot.

Aspect 24. A front jaw for a touring ski binding, wherein the front jaw preferably corresponds to at least one of the preceding aspects, the front jaw comprising:

a base (1);

two lateral sole retainers (13) which lie opposite each other in relation to a longitudinal axis (L) of the front jaw and comprise a boot retainer pin (14) each and which, in a pivoted-in state, are engaged with complementary bearings formed on a ski boot, in order to define a pivoting axis for the ski boot which extends substantially transverse to the longitudinal axis (L) of the front jaw, and which can be adjusted between the pivoted-in state, in which the boot retainer pins (14) are engaged with the complementary bearings of the ski boot, and a pivoted-away state in which the engagement is released;

spring elements (15) for tensioning the lateral sole retainers (13);

a tensioning lever (16) for moving the sole retainers (13) from the pivoted-in state to the pivoted-away state in which they release the ski boot;

optionally, a latching lever (17) for latching the lateral sole retainers (13) for walking in skis;

an axial abutment (5, 5*a*, 5*b*) which is arranged in front of the boot retainer pins (14) in the latching direction and comprises a rearward abutting area for the sole of the ski boot, wherein a thermoplastic elastomer (TPE) forms the abutment (5, 5*a*, 5*b*) or at least the rearward abutting area.

Aspect 25. The front jaw according to the preceding aspect, wherein the base (1) forms a base structure (6) for the abutment (5, 5*a*, 5*b*), and the abutment (5, 5*a*, 5*b*) itself consists of an elastic material which is or can be connected to the base structure (6).

Aspect 26. The front jaw according to the preceding aspect and any one of Aspects 1 to 23, wherein the elastic material for the abutment (5, 5*a*, 5*b*) is the same elastic material as for the cover (3).

Aspect 27. The front jaw according to any one of the preceding three aspects, wherein the abutment (5, 5*a*, 5*b*)

comprises a transit opening (5*f*) through which an axial body (8) protrudes, in order to fix the abutment (5, 5*a*, 5*b*) to the base.

Aspect 28. The front jaw according to any one of the preceding four aspects and any one of Aspects 1 to 23, wherein the abutment (5) is connected to the cover (3)/at least one of the covers and preferably original-moulded in one piece with the cover (3)/at least one of the covers.

Aspect 29. The front jaw according to any one of the preceding five aspects, wherein the abutment (5, 5*a*, 5*b*) is suitable for compensating for unavoidable production tolerances of ski boot soles.

Aspect 30. The front jaw according to any, one of the preceding aspects, wherein the latching lever (17) comprises a locking element (17*b*) which, for the purpose of latching, locks into a complementary locking element (4) formed by the base (1), wherein the latching lever (17) is connected to the tensioning lever (16), preferably such that it can be pivoted, and can be pivoted relative to the tensioning lever (16), into the latching position.

Aspect 31. The front jaw according to any one of the preceding aspects, wherein the base (1) is original-moulded in one part, for example from a near-non-deformable plastic or a light metal, for example in an injection-moulding method or generative method.

Aspect 32. The front jaw according to any one of the preceding aspects, wherein the cover (3) and/or the abutment (5) is moulded from a thermoplastic elastomer (TPE) such as for example thermoplastic polyurethane (TPU).

Aspect 33. The front jaw according to any one of the preceding aspects, wherein the base (1) is moulded from a first plastic material, and the cover (3) and/or the abutment (5) is moulded from another, second plastic material, and the second plastic material has a smaller Shore hardness than the first plastic material.

Aspect 34. The front jaw according to any one of the preceding aspects, wherein the base (1) is moulded from a thermoplastic plastic material such as for example carbon fibre-reinforced polyamide.

BRIEF DESCRIPTION OF THE DRAWINGS

In the following, an example embodiment of the invention is explained in more detail on the basis of figures, without thereby limiting the subject-matter to the example embodiment shown. Features essential to the invention which can only be gathered from the figures form part of the scope of the invention and can advantageously develop the subject-matter of the invention.

a) a perspective view from the side;

b) a plan view;

c) a perspective view from above;

d) a perspective view from above.

Figure 1:
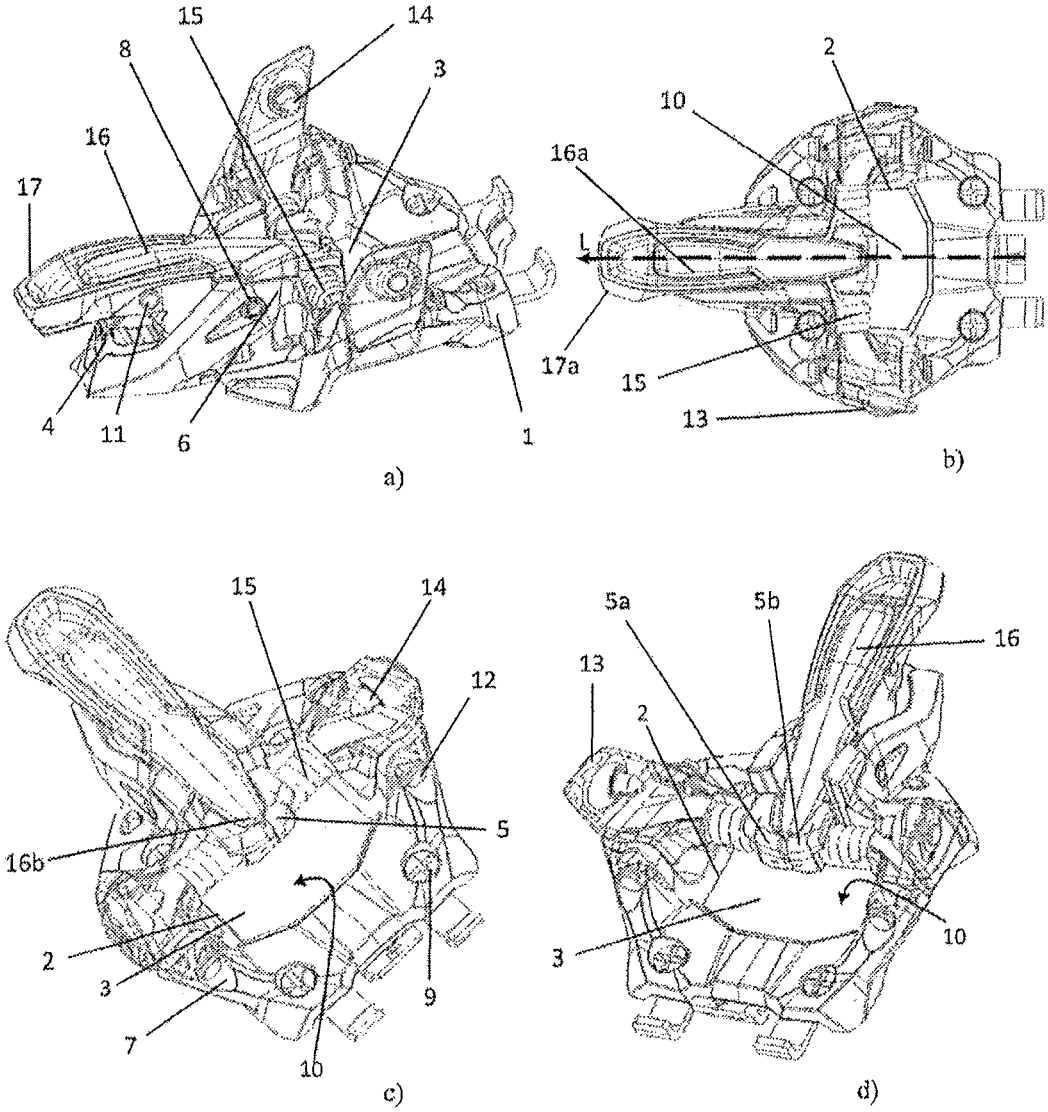
FIG. 1 shows an example embodiment of a front jaw in four views.
Figure 2:
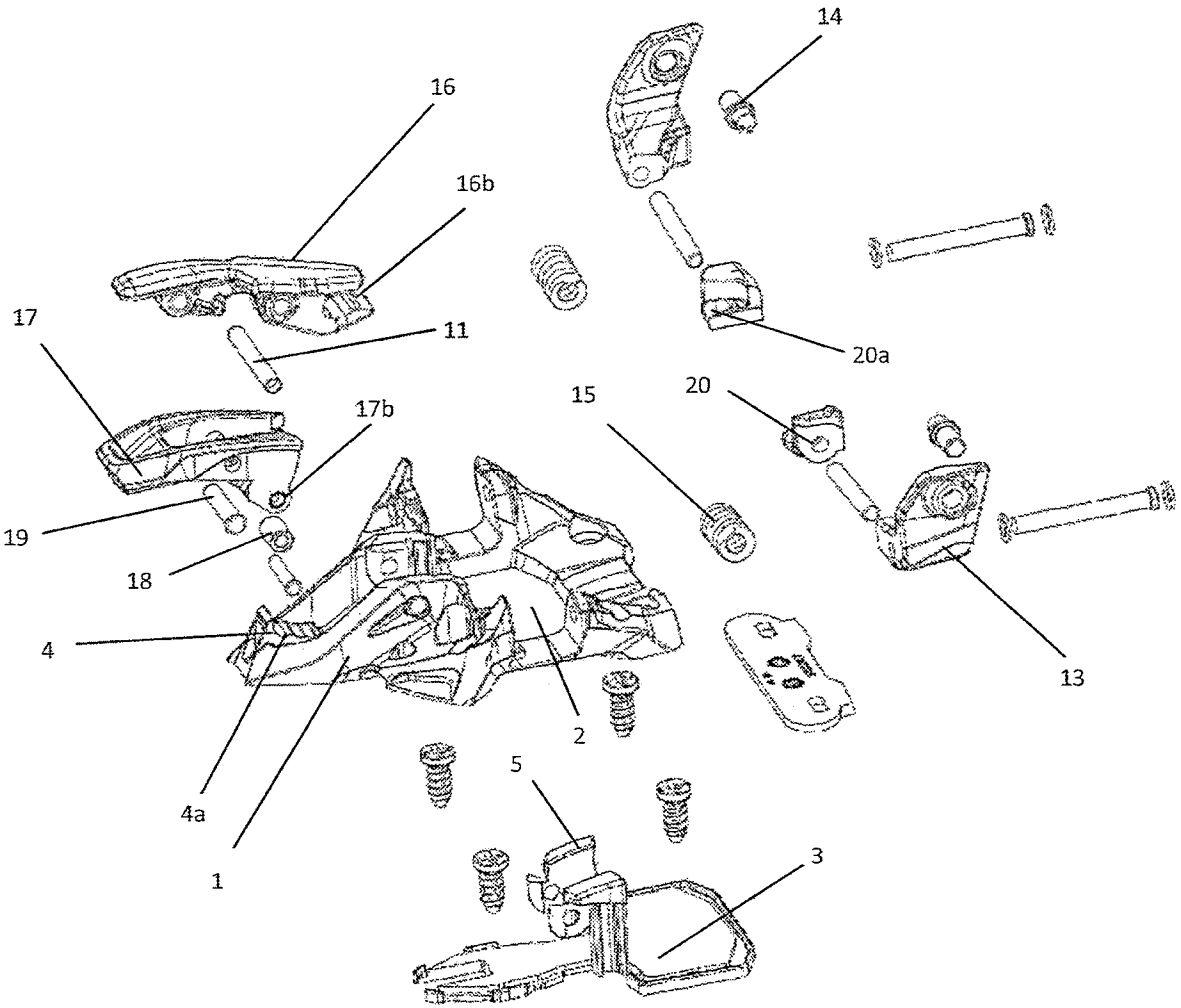

FIG. 2 shows an exploded drawing of the front jaw of FIG. 1.

Figure 3:
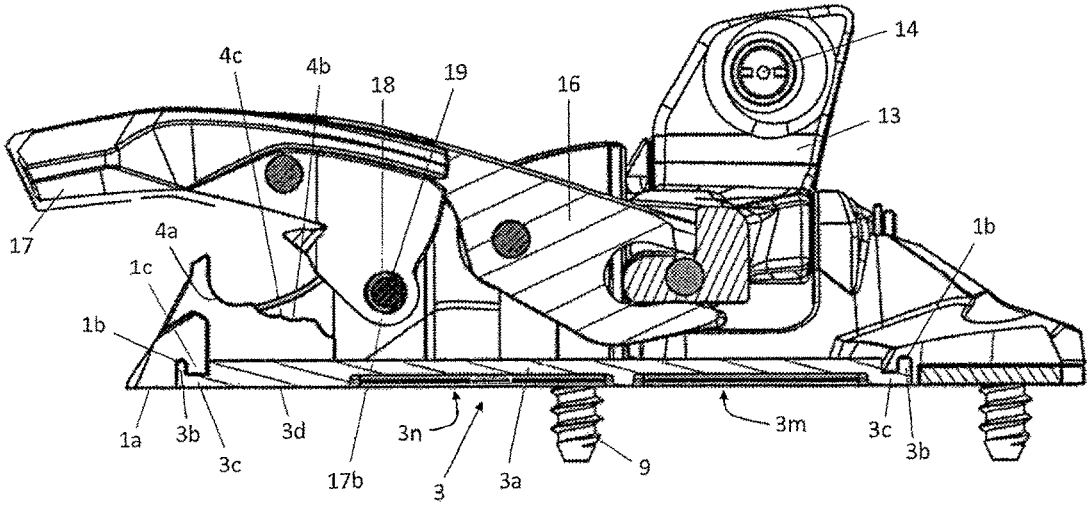

FIG. 3 shows a sectional view of the front jaw of FIG. 1 along a longitudinal axis in the skiing direction.

Figure 4:
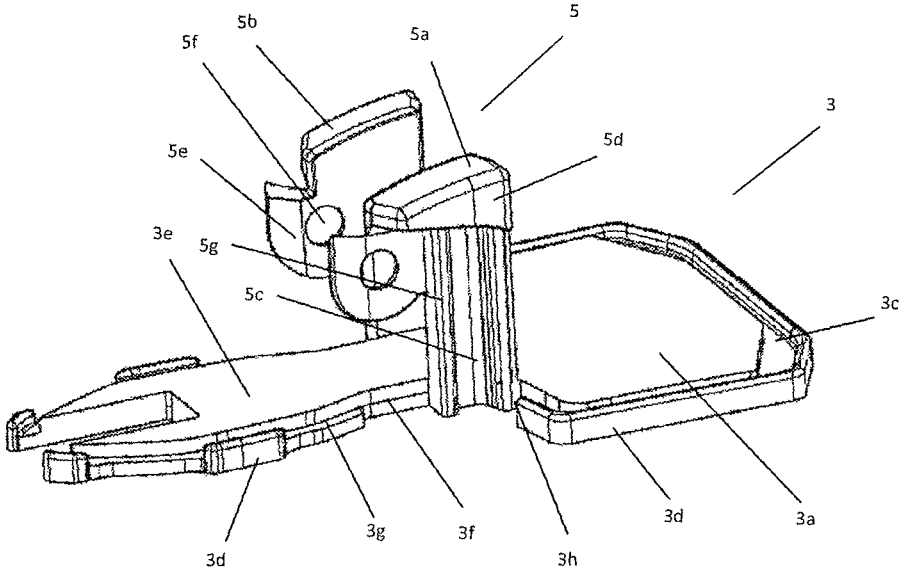

FIG. 4 shows in a perspective view onto a cover or snow deflector.

Figure 5:
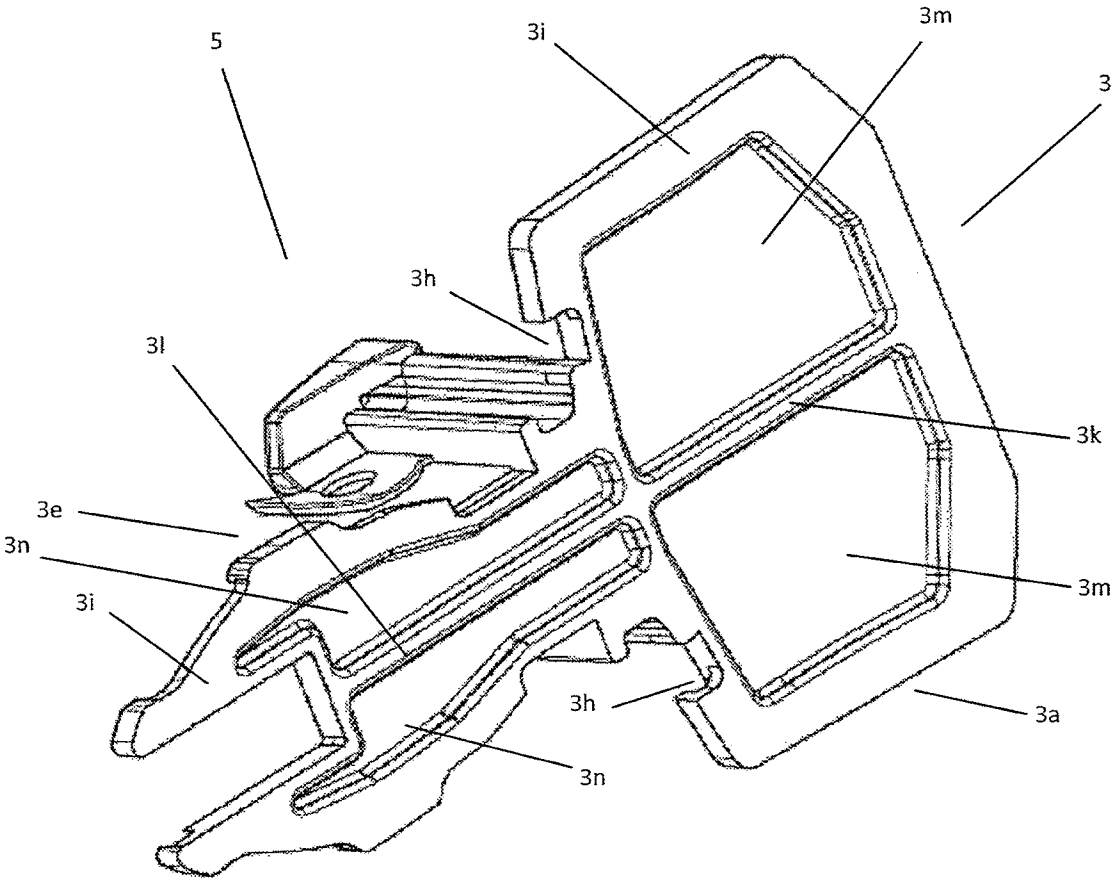

FIG. 5 shows the cover and/or snow deflector of FIG. 4 in a perspective view from below.

DETAILED DESCRIPTION OF THE INVENTION

The four views in FIG. 1 all show the same one example embodiment of a toe retainer or front jaw in accordance with the invention, but from four different angles of view. The description does not therefore differentiate between the views a), b), c) and d). The views as a whole show all the reference signs, without the all reference drawings are given in each of the drawings.

The toe retainer or front jaw of the example embodiment shown is the front jaw of a pin binding and comprises two sole retainers 13, each comprising a pin 14 which can engage with openings formed on a ski boot or, respectively, a ski boot sole, in order to connect a ski to the ski boot. When engaged with the ski boot, the pins 14 define a pivoting axis about which the ski boot, which is held in the front jaw, can be pivoted in a known way while walking or ski touring.

The sole retainer 13 can be pivoted into a first position, in which it releases the ski boot, and into a second position in which it connects front jaws to the ski. The front jaw comprises two spring elements 15 which are respectively assigned exclusively to one of the sole retainers 13 in the example embodiment and which secure the sole retainer in the first and/or second position against being unintentionally released from the respective position.

The sole retainers 13 are held such that they can be pivoted on the front jaw; in the example embodiment, they are held on an axial body 12, both ends of which are mounted in the base 1 of the front jaw. The sole retainers 13 can be pivoted together with the axial body 12 or on the axial body 12 which is mounted non-rotationally, for example in a positive fit, in the base 1, in order to move from the first position to the second position.

A tensioning lever 16 is connected to the base 1, such that it can be pivoted about an axle 8. The tensioning lever 16 comprises a first free end 16*a* which protrudes along the longitudinal centre axis L of the front jaw towards a tip of the ski (not shown). A second free end 16*b* of the tensioning lever 16 extends between the ends of the spring elements 15 which lie opposite each other.

The tensioning lever 16 is connected to a securing lever 17 in an additional pivoting axis or fixing axle 11, wherein the securing lever 17 prevents the tensioning lever 16 from being able to detach, such that the sole retainers 13 release the ski boot, when the binding is in the walking position.

When stepping into the binding or front jaw, the tensioning lever 16 and the securing lever 17 form a common lever, the free end 17*a* of which—being the free end 17*a* of the securing lever 17 in the skiing direction—has a minimum perpendicular distance with respect to the surface of the ski. When stepping into the front jaw until the sole retainers 13 lock in for downhill skiing in the ski binding, the tensioning lever 16 and the securing lever 17 are jointly pivoted away from the surface of the ski boot. This position is shown in FIG. 1 and can be clearly seen in FIG. 1*a*. If the binding is then to be used in touring mode, it is desirable for the front jaw to be separately secured against unintentionally detaching. To this end, the securing lever 17 can be gripped at the front free end 17*a* and pulled upwards relative to the tensioning lever 16, away from the surface of the ski, until a locking element 17*b*, which is formed on the securing lever 17, locks into a locking portion 4*a* of a complementary locking element 4.

When the tensioning lever 16 is moved into the downhill skiing position, the ends of the spring elements 15 facing the tensioning lever 16 are pressed upwards, and the two sole retainers 13 and the two pins 14 are thus moved towards each other and moved into engagement with the openings in the ski boot sole. When the tensioning lever 16 is in the downhill skiing position, it is advantageously possible to laterally release the toe retainer in the event of overload.

The base 1 is constructed skeletally and, in the example embodiment, comprises a transit opening 2 which is surrounded by the base 1 in the shape of a frame. In the example embodiment, the transit opening 2 is completely covered by a cover 3 so that no snow, ice or dirt can collect in the transit opening 2. In order to connect the cover 3 to the base 1 captively, it can be glued or fused to it or connected in some other way in a material fit and/or in a force fit and/or in a positive fit. Preferably, however, the cover 3 is connected to the base 1 solely in a positive fit, wherein the lower side 1*a* of the base 1 comprises one or more receptacles 1*b* (see FIG. 3) for corresponding engaging members 3*b* (see FIG. 4) which form part of the cover 3. The cover 3 is connected to the lower side 1*a* of the base 1, and the base 1 is connected to the ski by means of connecting elements, for example screws.

The front jaw also comprises an abutment 5 for a front end of the ski boot brine. The abutment 5 is in particular formed to be elastically deformable, in order to be able to compensate for production tolerances of the ski boot sole. In the example embodiment, the abutment 5 is formed in two parts 5*a*, 5*b* and the base 1 forms a base structure 6 to which the abutment 5*a*, 5*b* can be connected.

The abutment 5*a*, 5*b* is preferably original-moulded in one piece with the cover 3, for example in an injection-moulding method in one mould together with the cover 3, and particularly preferably manufactured from an identical material to the cover 3. The abutment 5, 5*a*, 5*b* and the base structure 6 can be connected solely in a positive fit. The abutment 5 and the base structure 6 can instead also be connected in a force fit and/or in a positive fit and in a force fit.

The surface 10 of the cover 3 can have snow-repellent, ice-repellent and/or dirt-repellent properties. These can be provided off-tool, i.e. in the die, and produced for example by specifically heating or cooling certain regions, or induced latterly for example by a heat treatment or other surface treatment, or generated by applying a coating.

The front jaw of the example embodiment is in particular characterised in that it consists—aside from the attachment parts such as the sole retainers 13, the securing lever 17 and the tensioning lever 16—of only two parts, namely the frame-shaped base 1 and the cover 3 comprising the moulded-on abutments 5*a*, 5*b*. Moreover, two relatively short spring elements 15 are sufficient in order to securely connect a ski to a ski boot via the sole retainers 13. The front jaw as a whole is a weight-optimised front jaw which exhibits a very low weight, which is advantageous particularly while ski touring uphill.

FIG. 2 shows the components of the toe retainer of FIG. 1 in an exploded drawing.

The tensioning lever 16 and the securing lever 17 are shown separately from each other and can be connected to each other via the fixing axle 11. The base 1 including the base structure 6 is original-moulded in one piece, as is the cover 3 comprising the abutments 5*a*, 5*b*, wherein the base 1 is formed from a solid material, for example a light metal or preferably plastic, for example a reinforced plastic, which exhibits similar properties. The cover 3, by contrast, is for example made of an elastic or highly elastic thermoplastic or an elastomer which remains sufficiently elastic even at temperatures of minus 15° C. or less, as are to be expected in snow sports. The cover 3 preferably consists of a thermoplastic elastomer (TPE) such as for example thermoplastic polyurethane (TPU).

The end 16*b* of the tensioning lever 16 is formed in the shape of a fork. The fork-shaped end 16*b* protrudes around the setting elements 20, in order to adjust the sole retainers 13 in a region 20*a*.

The securing lever 17 comprises the locking element 17*b* which can lock into a locking portion 4*a* of the complementary locking element 4 in order to secure the front bundle in the walking position.

FIG. 3 shows a sectional view of the toe retainer of FIG. 1 in the position for downhill skiing, i.e. the tensioning lever 16 and the securing lever 17 still appear as a common lever. The locking element 17*b* is not locked in the locking portion 4*a* of the complementary locking element 4; the sole retainers 13 would connect a ski boot, placed in the toe retainer, to the ski. The tensioning lever 16 is connected to the securing lever 17 in an axle 19. A rolling body 18 can be rotatably arranged on the axle 19.

The cover 3 is connected to the base 1, in a positive fit as is preferred though merely by way of example. Connecting grooves 1*b* are formed in the lower side 1*a* of the base 1, wherein an outer circumferential edge 3*b* of the cover 3 engages with the connecting grooves 1*b*. The lower side 3*d* of the cover 3 is flush with the lower side 1*a* of the base. The cover 3 forms depressions 3*m*, 3*n* which allow the cover 3 to act like a membrane in the region of the depressions 3*m*, 3*n* and can prevent and/or counteract the adhesion of snow or ice on a surface of the cover 3 facing the ski boot.

In the example embodiment shown, the locking element 17*b* is guided along a linkage rail 4*b* comprising multiple elevations 4*c*, into the locking portion 4*a* of the complementary locking element 4. The locking element 17*b* can comprise a rolling body 18 (see FIG. 2) which is mounted on an axle 19 and rolls off on the linkage rail 4*b* when the locking element 17*b* moves along the linkage rail 4*b*, thus reducing a frictional resistance between the linkage rail 4*b* and the locking element 17*b*.

FIG. 4 shows the cover 3 comprising the abutments 5*a* and 5*b*. The cover 3 comprises a planar region 3*a* which lies underneath the ski boot sole of a ski boot held in the binding. A groove 3*c* is formed next to an outer circumferential edge 3*b*. When the cover 3 is connected to the lower side 1*a* of the base 1, the circumferential edge 3*b* engages with the connecting grooves 1*b* formed in the base 1, in order to connect the cover 3 to the base 1 in a positive fit. When connected, the lower side 3*d* of the cover 3 is flush with the lower side 1*a* of the base 1 in the example embodiment (see FIG. 3).

A longitudinal region 3*e* which extends to the front end of the base 1 in the skiing direction, and at least portions of which have the circumferential edge 3*b* and, in these portions, the groove 3*c*, is connected to the planar region 3*a*. In the portions 3*f* with no circumferential edge 3*b*, a sealing area 3*g* can be formed which abuts the lower side 1*a* of the base 1, forming a seal, when the front jaw is fitted onto the ski. The longitudinal region 3*e* of the example embodiment is sub-divided, at its free end, into two parts which protrude around the sides of the complementary locking element 4.

The abutment 5 for the tip of the ski boot is formed at the transition between the planar region 3*a* and the longitudinal region 3*e*; in the example embodiment, the abutment 5 consists of the two abutments 5*a* and 5*b*. The abutments 5*a*, 5*b* project perpendicularly from a surface of the cover 3 facing away from the surface of the ski and each comprise an abutment root 5*c*, an abutment tip 5*d* and an connecting lug 5*e* comprising a transit opening 5*f*, through which the axial body 8 protrudes, such that the connecting lugs 5*e* are fixed between the base 1 and the tensioning lever 16, such that the abutments 5*a*, 5*b* are also substantially fixed relative to the base 1. At least the abutment root 5*c* has an edge 5*g* which corresponds to the circumferential edge 3*b* and, as already described, engages with a connecting groove of the base 1.

In the example embodiment, the circumferential edge 3*b* and the groove 3*c* do not extend as far as the attaching root 5*c* but rather terminate before that, such that an opening 3*h* or, respectively, two openings 3*h* are created directly next to the abutments 5*a*, 5*b*. The base 1 can also have a cavity in the region of the openings 3*h*, such that a lower side 3*d* of the cover 3 is for example connected to the environment via these openings 3*h*, as is described in even more detail with respect to FIG. 5.

FIG. 5 shows the cover 3 of FIG. 4 in a view from below. The planar region 3*a* and the longitudinal region 3*e* jointly form the cover 3. The planar region 3*a* has an all-round lower side edge region 3*i* which is formed on the lower side of the cover 3 in the region of the circumferential edge 3*b* and the groove 3*c*. The longitudinal region 3*e* likewise comprises the lower side edge region 3*i*. The lower side edge region 3*i* forms a contact area together with the ribs 3*k*, 3*l* in the planar region 3*a* and in the longitudinal region 3*e* in the example embodiment, wherein the cover lies on the surface of the ski over said contact area when the toe retainer is fitted. The lower side edge region 3*i* and the ribs 3*k*, 3*l* simultaneously form two depressions 3*m*, 3*n* in each of the planar region 3*a* and longitudinal region 3*e*, wherein said depressions 3*m*, 3*n* open downwardly towards the surface of the ski and are sealed upwardly by a thin layer of material of the cover 3 which acts like an elastic film.

When the cover 3 is compressed by the ski boot, the air trapped in the depressions 3*m*, 3*n* can become compressed. When this compression is subsequently released, the air can expand again, preferably abruptly, such that the cover 3 elastically re-assumes its original shape prior to compression. This can prevent—better than before—ice or snow from being able to accumulate in the region of the contact 3.

In the example embodiment, the lower side edge region 3*i* is narrow in the region of the openings 3*h*, such that if at least one of the depressions 3*m* becomes extremely compressed, such that the depression 3*m* could for example burst, air can flow out in this region and, when the compression is subsequently released, also flow back in.

As can be seen in FIGS. 3 to 5, the cover 3 has a holding flange 3*c* adjoining the planar region 3*a* laterally on the outer side, i.e. the planar region 3*a* is raised and projects upwards from the lateral holding flange 3*c*. In the example embodiment, in which the base 1 has the transit opening 2, the planar region 3*a* protrudes into the transit opening 2 and at least substantially fills it—in the example, as is preferred, completely and laterally abutting, and forming a seal in advantageous embodiments. When the front jaw is fitted on the ski, which is achieved by means of the fastening elements 9, the base 1 presses the cover 3 against the surface of the ski in the region of the holding flange 3*c*. For this purpose, the base 1 has one or more constraining structures 1*c* via which it acts on the holding flange 3*c* when fitted. The base 1 thus acts as a constrainer for the cover 3.

In the fitted state, the depressions 3*m* and 3*n* and the ski form compressible hollow spaces which act as air cushions. The membrane regions, via which the cover 3 delineates these hollow spaces 3*n* and 3*m* upwardly—towards the lower side of the sole of a ski boot held in the front jaw—in the raised planar region 3*a*, can elastically yield into the respective hollow space 3*m* and/or 3*n*. The depth of the hollow spaces and/or depressions 3*m* and 3*n*, as measured orthogonally with respect to the lower side 3*d* of the cover 3, is at least 0.5 mm, or even better at least 1 mm, in advantageous embodiments. Conversely, it is advantageous if the depth is at most 10 mm, or even better at most 8 mm.

LIST OF REFERENCE SIGNS

1 base
1*a* lower side
1*b* receptacle, connecting groove
1*c* is constraining structure
2 transit opening
3 cover
3*a* planar region
3*b* engaging member, outer circumferential wall
3*c* holding flange, groove
3*d* lower side
3*e* longitudinal region
3*f* portion
3*g* sealing area
3*h* opening
3*i* lower side edge region
3*k* rib
3*l* rib
3*m* depression
3*n* depression
4 complementary locking element
4*a* locking portion
4*b* linkage rail
4*c* increase
5 abutment
5*a* abutment
5*b* abutment
5*c* abutment root
5*d* abutment tip
5*e* connecting lug
5*f* transit opening
5*g* edge
6 base structure
7 receptacle
8 axial body
9 fastening element
10 surface
11 fixing axle
12 axial body
13 sole retainer
14 pin, boot retainer pin
15 spring element
16 tensioning lever
16*a* free end
16*b* free end
17 securing lever
17*a* end
17*b* locking element
18 rolling body
19 axle
20 setting element
20*a* region
L longitudinal axis of the front jaw

The invention claimed is:

1. A front jaw for a touring ski binding, comprising:

a) a base;

b) at least one recess or transit opening in the base;

c) two lateral sole retainers which lie opposite each other in relation to a longitudinal axis of the front jaw and comprise a boot retainer pin each and which, in a pivoted-in state, co-operate with complementary bearings formed on a ski boot, in order to define a pivoting axis for the ski boot which extends substantially transverse to the longitudinal axis of the front jaw, and which can be adjusted between the pivoted-in state, in which the complementary bearings of the ski boot engage with the boot retainer pins, and a pivoted-away state in which the complementary bearings of the ski boot no longer engage with the boot retainer pins;

d) spring elements for tensioning the lateral sole retainers; and e) a tensioning lever for moving the sole retainers from the pivoted-in state to the pivoted-away state in which they release the ski boot from a downhill skiing position or a walking position;

f) wherein the at least one recess or transit opening is covered by one or more covers, the respective cover manufactured as a separate part from the base.

2. The front jaw according to claim 1, wherein the cover or covers is/are detachably connected to the base.

3. The front jaw according to claim 2, wherein the respective cover is connected to the base in a positive fit and/or in a force fit.

4. The front jaw according to claim 1, wherein the base surrounds the recess or transit opening in the shape of a frame.

5. The front jaw according to claim 1, wherein the cover/covers comprises an at least substantially all-round circumferential edge on a lower side facing away from a ski boot sole, wherein said circumferential edge forms a contact area of the cover on an upper side of the recess or the surface of the ski facing the cover.

6. The front jaw according to claim 5, wherein the cover/covers comprises one or more additional rib-shaped reinforcements on the lower side facing away from the ski boot sole, wherein said reinforcement/reinforcements form(s) a contact area of the cover on an upper side of the recess or the surface of the ski facing the cover.

7. The front jaw according to claim 5, wherein regions of the cover/covers between the contact area of the circumferential edge and/or the one or more additional reinforcements form elastic membrane regions which prevent snow, ice or dirt from accumulating on the surface of the cover/covers.

8. The front jaw according to claim 1, wherein the front jaw comprises at least one abutment for a front end of a ski boot.

9. The front jaw according to claim 8, wherein the base forms a base structure for the abutment, and the abutment itself consists of an elastic material which is or can be connected to the base structure.

10. The front jaw according to claim 1, wherein the cover is held in position by the base when the front jaw is fitted on the ski.

11. The front jaw according to claim 1, wherein the cover has:

a raised planar region comprising an upper free surface facing the ski boot sole; and a holding flange which protrudes outwards from the raised planar region; and wherein the raised planar region projects upwards from the holding flange and at least substantially fills the transit opening or recess in a plan view onto the front jaw.

12. The front jaw according to claim 1, wherein the base forms a constrainer for the cover and presses the cover towards and preferably against the upper side of the ski when the front jaw is fitted on the ski.

13. The front jaw according to claim 1, wherein:

the cover has a planar region comprising an elastically yielding membrane having an upper free surface facing the ski boot sole;

said planar region at least substantially fills the transit opening or recess in a plan view onto the front jaw;

the cover has a hollow space below the membrane or forms a hollow space below the membrane when the front jaw is fitted; and the membrane can yield into the hollow space.

14. The front jaw according to claim 1, wherein the recess or transit opening and the cover extend between the lateral sole retainers.

15. The front jaw according to claim 1, wherein the respective cover is made from an elastic material.

16. The front jaw according to claim 1, wherein the respective cover is moulded from a thermoplastic elastomer (TPE).

17. The front jaw according to claim 1, wherein the base is moulded from a first plastic material, and the respective cover is moulded from another, second plastic material, and the second plastic material has a smaller Shore hardness than the first plastic material.

18. A front jaw for a touring ski binding, comprising:

a base;

at least one recess or transit opening in the base;

two lateral sole retainers which lie opposite each other in relation to a longitudinal axis of the front jaw and comprise a boot retainer pin each and which, in a pivoted-in state, co-operate with complementary bearings formed on a ski boot, in order to define a pivoting axis for the ski boot which extends substantially transverse to the longitudinal axis of the front jaw, and which can be adjusted between the pivoted-in state, in which the complementary bearings of the ski boot engage with the boot retainer pins, and a pivoted-away state in which the complementary bearings of the ski boot no longer engage with the boot retainer pins;

spring elements for tensioning the lateral sole retainers; and a tensioning lever for moving the sole retainers from the pivoted-in state to the pivoted-away state in which they release the ski boot from a downhill skiing position or a walking position;

wherein the at least one recess or transit opening is covered by one or more covers;

wherein the cover/covers comprise(s) an at least substantially all-round circumferential edge and/or one or more rib-shaped reinforcements on a lower side facing away from a ski boot sole, wherein said circumferential edge and/or reinforcement/reinforcements form(s) a contact area of the cover on an upper side of the recess or the surface of the ski facing the cover; and wherein regions of the cover/covers between the contact area of the circumferential edge and/or the one or more reinforcements form elastic membrane regions which prevent snow, ice or dirt from accumulating on the surface of the cover/covers.

19. The front jaw according to claim 18, wherein the cover/covers is/are held in position by the base when the front jaw is fitted on the ski.

20. A front jaw for a touring ski binding, the front jaw comprising:

a base;

two lateral sole retainers which lie opposite each other in relation to a longitudinal axis of the front jaw and comprise a boot retainer pin each and which, in a pivoted-in state, are engaged with complementary bearings formed on a ski boot, in order to define a pivoting axis for the ski boot which extends substantially transverse to the longitudinal axis of the front jaw, and which can be adjusted between the pivoted-in state, in which the boot retainer pins are engaged with the complementary bearings of the ski boot, and a pivoted-away state in which the engagement is released;

spring elements for tensioning the lateral sole retainers;

a tensioning lever for moving the sole retainers from the pivoted-in state to the pivoted-away state in which they release the ski boot;

an axial abutment which is arranged in front of the boot retainer pins in the latching direction and comprises a rearward abutting area for the sole of the ski boot, wherein a thermoplastic elastomer forms the abutment so that the abutment is elastically deformable.

21. The front jaw according to claim 20, wherein the base forms a base structure for the abutment, and the abutment itself consists of an elastic material which is or can be connected to the base structure.

* * * * *